US008915806B2

(12) United States Patent
Asherman

(10) Patent No.: US 8,915,806 B2
(45) Date of Patent: Dec. 23, 2014

(54) ARROW SHAFT

(76) Inventor: Richard Asherman, Cody, WY (US)

( * ) Notice: Subject to any disclaimer, the term of this patent is extended or adjusted under 35 U.S.C. 154(b) by 0 days.

(21) Appl. No.: 13/333,683

(22) Filed: Dec. 21, 2011

(65) Prior Publication Data

US 2012/0157247 A1 Jun. 21, 2012

Related U.S. Application Data

(60) Provisional application No. 61/425,649, filed on Dec. 21, 2010.

(51) Int. Cl.
*F42B 6/04* (2006.01)
*F42B 10/38* (2006.01)

(52) U.S. Cl.
CPC .. *F42B 6/04* (2013.01); *F42B 10/38* (2013.01)
USPC ..... 473/578

(58) Field of Classification Search
USPC ..... 473/578
See application file for complete search history.

(56) References Cited

U.S. PATENT DOCUMENTS

| | | | |
|---|---|---|---|
| 5,273,293 | A | 12/1993 | Lekavich |
| 5,277,423 | A | 1/1994 | Artus |
| 5,443,272 | A | 8/1995 | Vincent, Sr. |
| 5,842,942 | A | 12/1998 | Doht et al. |
| 5,921,870 | A | 7/1999 | Chiasson |
| 5,971,875 | A | 10/1999 | Hill |
| 6,027,414 | A | 2/2000 | Koebler |
| 6,129,642 | A | 10/2000 | DonTigny |
| 6,520,876 | B1 | 2/2003 | Eastmann, II |
| 6,554,725 | B1 | 4/2003 | Schaar |
| 6,595,868 | B1 | 7/2003 | Androlia |
| 6,609,981 | B2 | 8/2003 | Hirata |
| 6,866,599 | B2 | 3/2005 | Eastmann, II |
| 6,997,827 | B1 | 2/2006 | Grace, Jr. et al. |
| 7,374,504 | B2 | 5/2008 | Palomaki et al. |
| 7,608,001 | B2 | 10/2009 | Palomaki et al. |
| 7,608,002 | B2 | 10/2009 | Eastmann, II et al. |
| 7,686,714 | B2 | 3/2010 | Smith et al. |
| 7,717,814 | B1 | 5/2010 | Sanford |

*Primary Examiner* — John Ricci

(57) ABSTRACT

An arrow includes an elongate shaft, a plurality of vanes located proximate a proximal end of the shaft, and a point located proximate a distal end of the shaft. The shaft may have a dimpled outer surface. The shaft may also or alternatively have an internal supporting structure.

15 Claims, 9 Drawing Sheets

ARROW SHAFT

CROSS-REFERENCE TO RELATED APPLICATIONS

This application claims priority to and the benefit of U.S. Provisional Patent Application Ser. No. 61/425,649, filed Dec. 21, 2010, entitled "Arrow Design," the disclosure of which is hereby incorporated by reference herein in its entirety.

INTRODUCTION

Arrows include an elongate shaft having a point on a distal end and a notch on a proximal end. Therebetween, proximate the notch, are a number of vanes or fletches, which help direct flight of the arrow. A variety of configurations and technologies utilized in arrow design are known in the art. Examples of current arrow designs include U.S. Pat. No. 7,608,001, the disclosure of which is hereby incorporated by reference herein in its entirety. The market constantly seeks advances in technology to improve flight and accuracy.

SUMMARY

In one aspect, the technology relates to an arrow having: an elongate shaft including a plurality of dimples; a plurality of vanes located proximate a proximal end of the shaft; and a point located proximate a distal end of the shaft. In another aspect, the technology relates to an arrow having: an hollow elongate shaft including a plurality of interior walls; a plurality of vanes located proximate a proximal end of the shaft; and a point located proximate a distal end of the shaft.

BRIEF DESCRIPTION OF THE DRAWINGS

There are shown in the drawings, embodiments which are presently preferred, it being understood, however, that the technology is not limited to the precise arrangements and instrumentalities shown.

DETAILED DESCRIPTION

Figure 1:
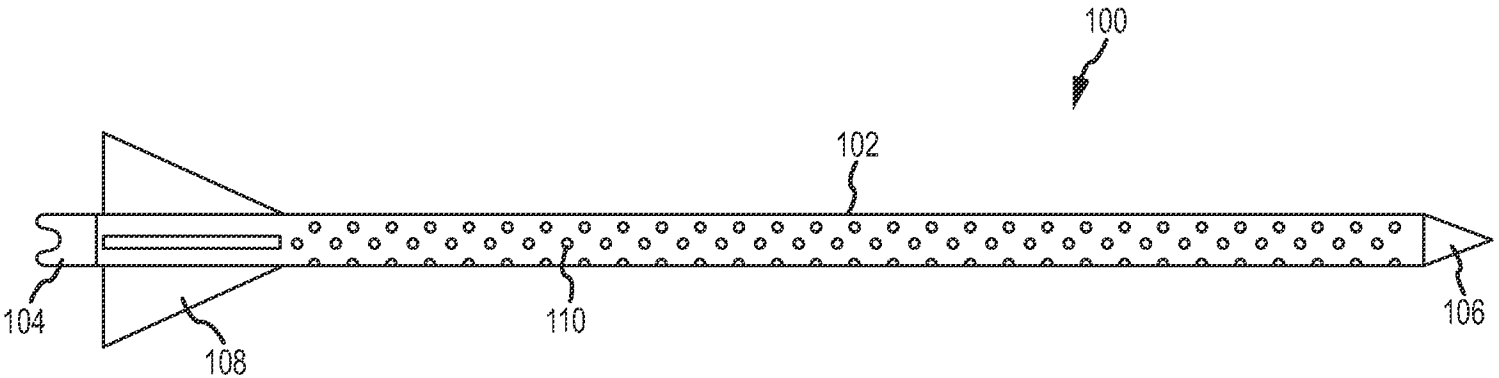
FIG. 1 is a side view of an arrow.

FIG. 1 depicts an arrow 100 including an elongate shaft 102. The shaft 102 includes a nook 104 at a proximal end and a point 106 at a distal end. A number of vanes or fletches 108 are located proximate the nook 104. The shaft 102 includes an textured outer surface that produces a stronger, lighter, and more aerodynamic arrow 100. This surface texture decreases the arrow skin friction as well as pressure drag. Additionally, the overall stiffness of the arrow 100 is increased. The increased stiffness of the arrow 100 allows for an arrow with a smaller diameter shaft to be produced with similar stiffness to arrows currently in production. Additionally, the surface texture also produces a dampening effect on the vibrations placed upon the arrow 100 upon release and in flight. This allows the arrow 100 to stabilize itself in a reduced time and distance, thus improving the accuracy.

Many different surface textures including scales, dimples and concentric ridges could be used alone or in combination. For the purposes of illustration, this specification will discuss a surface texture utilizing a number of dimples 110. In that embodiment, dimples 110 are formed by creating depressions in the exterior surface of the shaft 102. In an embodiment the pattern of dimples on the arrow shaft is based on an offset lattice structure, similar to the atomic structure found in titanium and zinc.

Figure 2A:
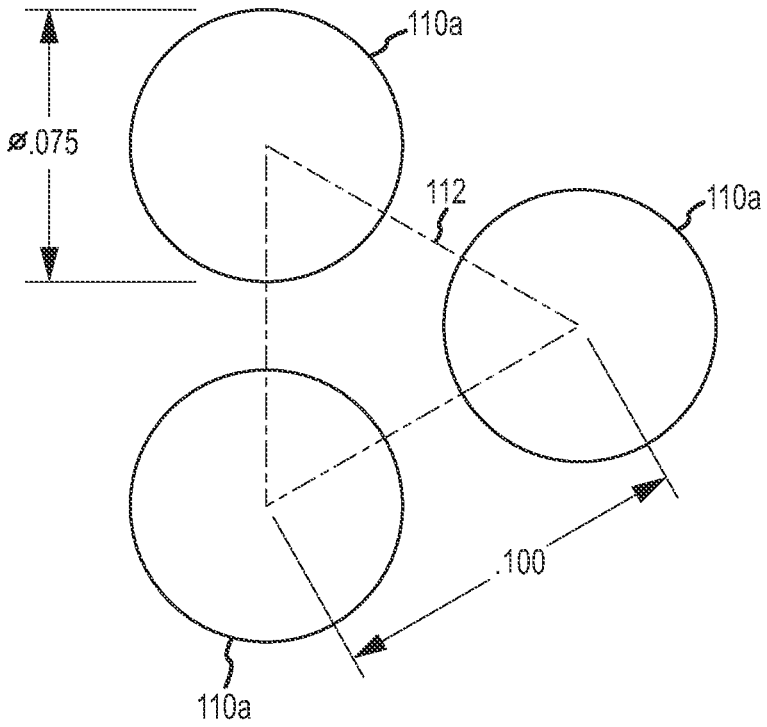
FIGS. 2A-2D are enlarged views of dimple patterns.

FIG. 2A depicts an enlarged view of the dimple pattern of the arrow 100 of FIG. 1. If the arrow 100 were unrolled onto a flat surface, each new row of dimples 110 would be offset with the previous row by half of the distance between each dimple 110 of the same row. In a polar coordinate system based around the central axis of the arrow shaft 102, each successive row would be offset with the previous row by half of the angle difference between each dimple 110 on the current row. This lays each row of dimples 110 so that it forms a hexagonal closed pack structure, the most volume-efficient packing structure, across the outer circumference of the arrow shaft 102. That is, if one were to draw a line connecting the center of two dimples in the current row with the center of the dimple in the adjacent row, an equilateral triangle 112 would be formed, as depicted in FIG. 2A.

Figure 2B:
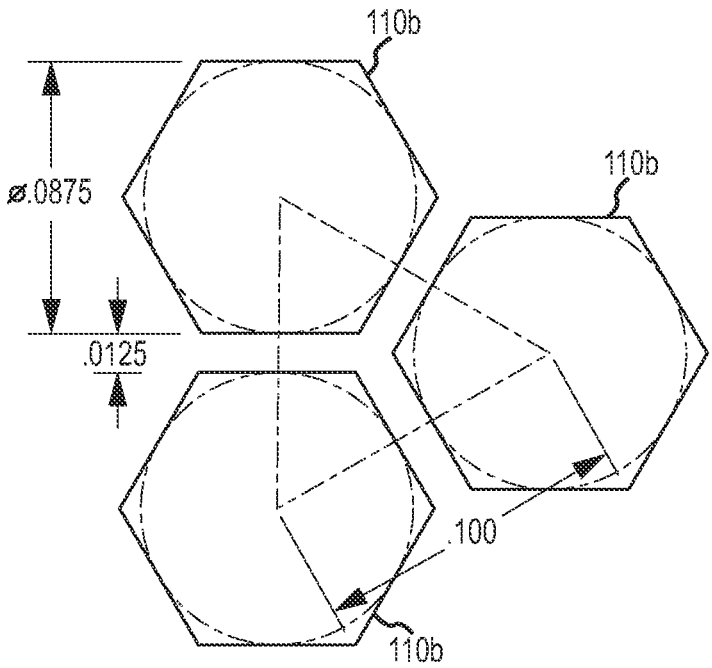

Any suitable dimple shape may be utilized. Examples of suitable dimple shapes include spherical dimples 110*a* depicted in FIG. 2A and hexagonal dimples 110*b* depicted in FIG. 2B. In FIG. 2A, the diameter of each spherical dimple is taken to be 0.075 inches. This dimple pattern depicts two rows of 0.075 inch diameter circular dimples 110*a*, offset by 0.10 inches from each respective diameter. Three dimples from two different rows create the equilateral triangle 112. In an arrow shaft having an outer diameter of 0.25 inches, a pattern of eight dimples per row would be formed. In FIG. 2B, the diameter of a circle inscribing each hexagonal dimple 110*b* is taken to be 0.875 inches. This dimple pattern depicts two rows of 0.0875 inch diameter hexagon dimples, offset by a distance of approximately 0.0125 inches from each respective parallel face. Three dimples from two different rows create the equilateral triangle 112. In an arrow shaft having an outer diameter of 0.25 inches, a pattern of eight dimples per row would be formed.

Figure 2C:
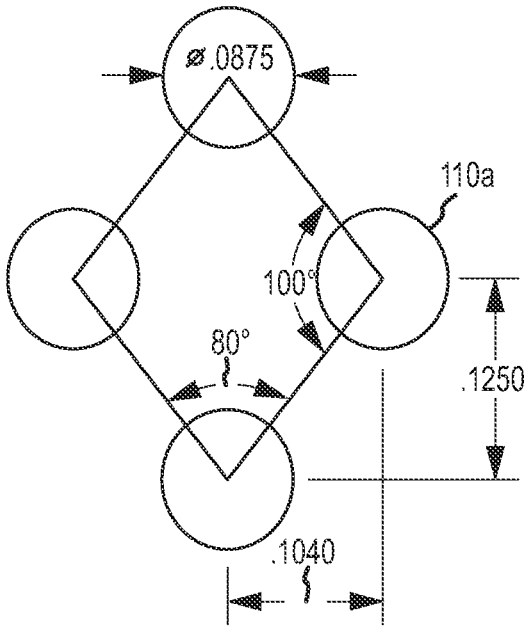
Figure 2D:
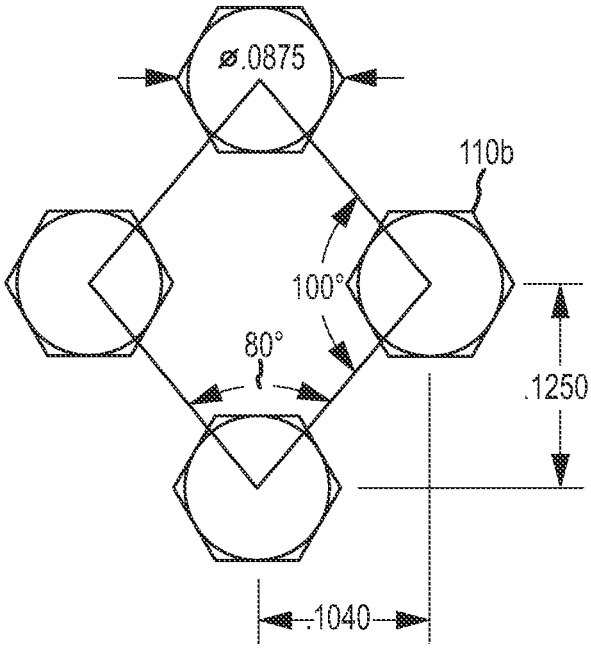

Alternative dimple patterns are depicted in FIGS. 2C and 2D. In these two patterns, the round dimples 110*a* and hexagonal dimples 110*b* are arranged such that the angles of the lines drawn from the geometric center of each dimple and its adjacent dimple is either about 80 degrees or about 100 degrees. Of course, the dimples 110*a*, 110*b* may be arranged such that any angular pattern is maintained. Alternatively, the dimples may be arranged at random about the outer wall of the shaft 102. The shape of the dimples may be determined based on desired performance, manufacturability, or other reasons. It has been demonstrated that a hexagonal dimple can provide superior aerodynamic drag properties as compared to its circular counterpart. It is believed that this is because of the increased surface area that a hexagonal shape can provide.

The dimples 110 disrupt the airflow over the arrow shaft 102 and create turbulent flow. While turbulent airflow over a smooth surface will typically increase skin friction and therefore aerodynamic drag, this turbulence, in combination with the dimpled surface, allows the airflow over the arrow shaft 102 to reduce skin friction through a reduction in boundary layer volume. By allowing the flow over the shaft 102 of the arrow 100 to separate later as compared to a smooth shaft, pressure drag is decreased as the pressure cell behind the arrow 100 during flight is reduced.

Although any suitable material or combination of materials may be used for the shaft 102, the desired stiffness of the arrow 100 will affect the choice of material for production. Examples of materials that may be used include aluminum alloy and carbon-fiber reinforced polymer. Other materials may also be used for the arrow shaft including wood. The surface texture technology discussed herein can be utilized in conjunction with any suitable shaft material or diameter.

The dimpled shafts may be manufactured using any suitable manufacturing technique now known or later developed. A number of manufacturing techniques are described below. For a ductile material such as an aluminum alloy, each dimple 110 may be pressed into the shaft 102 to a depth equivalent to either the wall thickness of the arrow shaft 102 or half the wall thickness of the arrow shaft 102. Other depths may also be used. If the inside of the arrow 100 is to remain smooth with a constant diameter, a hardened shaft or core may be inserted into the hollow interior of the shaft 102 prior to the pressing of the dimples 110. If the inside of the shaft wall is to deform with the pressing of the dimple, no shaft or core need be inserted. In one embodiment, the wall thickness of the arrow is to be taken as 0.015 inches and the overall diameter of the arrow is taken to be 0.25 inches. This process of work hardening the walls of the arrow shaft 102 will ultimately make the shaft 102 of the arrow 100 stronger and more elastic, while still retaining stiffness.

Alternatively, the dimples 110 may be cut from the surface of the shaft 102 using any milling process. Depending on the depth of the dimples 110, such a process may not significantly reduce the strength and stiffness of the arrow 100 but may still reduce overall weight.

In the embodiment depicted in FIG. 1, dimples 100 are provided along the entire length of the shaft 102. In an alternative embodiment, only a portion or portions of the shaft may be provided with dimples. For example, the fore portion and/or the aft portion of the shaft may be dimpled. This may be achieved using a rolling process. Two high strength and high hardness rollers with the final dimple pattern may be used. Each extruded arrow shaft may be placed between the rollers and compressed. As the rollers rotate, the dimple design may be pressed into the shaft of the arrow. If a hardened shaft is inserted into the arrow to retain the inside wall shape, it may be placed inside prior to rolling the dimples. In another embodiment, the dimples may cover less than or greater than about 50% of the shaft surface. In another embodiment, the pattern of dimples may cover substantially the full length of the shaft.

For a material such as a carbon-fiber reinforced polymer, a multi-part, reusable mold of the arrow may be constructed. This mold may be hollow on the inside with a positive impression of the dimples cast into its walls. A tube equal to the desired outer diameter of the arrow minus the thickness of the carbon-fiber sheets may first be coated in a layer of resin. Carbon-fiber sheets, for example, aligned at a 45 degree angle, may then be wrapped around this tube and placed within the confines of the positive dimple mold. Pressure may be applied uniformly on the mold to ensure that excess resin can escape. This mold then may be heated and cured as appropriate for carbon-fiber layups. As soon as the carbon-fiber mold has cured and is solid, the mold can be disassembled and the carbon-fiber arrow removed.

Figure 3:
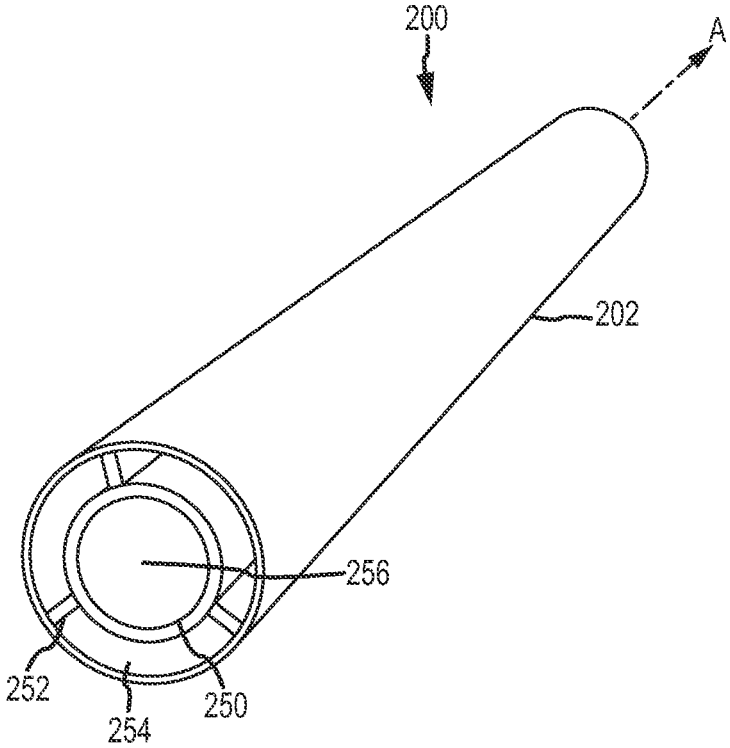
FIG. 3 is a perspective end view of an arrow shaft.
Figure 4A:
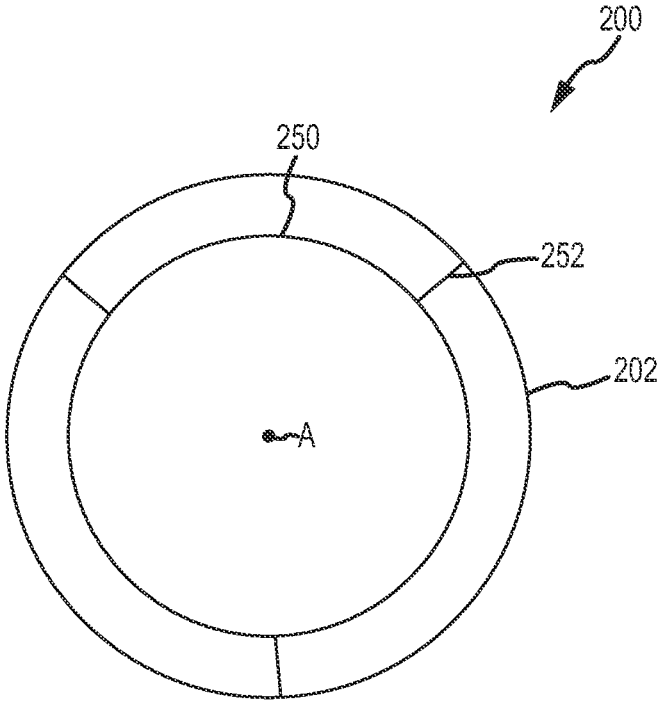
FIGS. 4A-4C are end views of arrow shafts.

FIG. 3 depicts a perspective end view of a shaft 202 of an arrow 200. The shaft 202 includes an internal reinforcing structure used to enhance the stiffness of the arrow 200, while maintaining a low mass. Any suitable geometry for this structure may be used such as, for example, a honeycomb structure. In the depicted embodiment, the structure includes an inner wall 250 concentric with the outer wall of the elongate shaft 102. A number of other walls 252 extending radially from an axis A of the shaft 202 connect the outer wall of the shaft 202 to the inner concentric wall 250. The walls 250, 252 form a number of voids such as peripheral voids 254 and a central void 256 within the shaft 202. An end view of the arrow 200 is depicted in FIG. 4A.

Figure 4B:
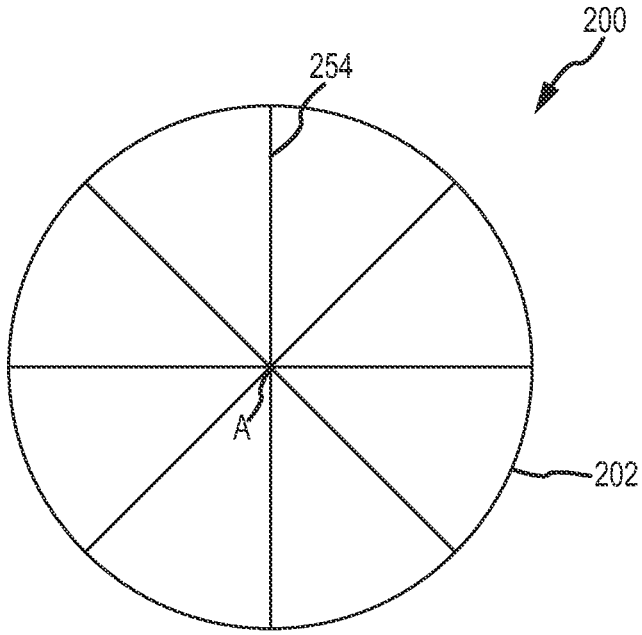
Figure 4C:
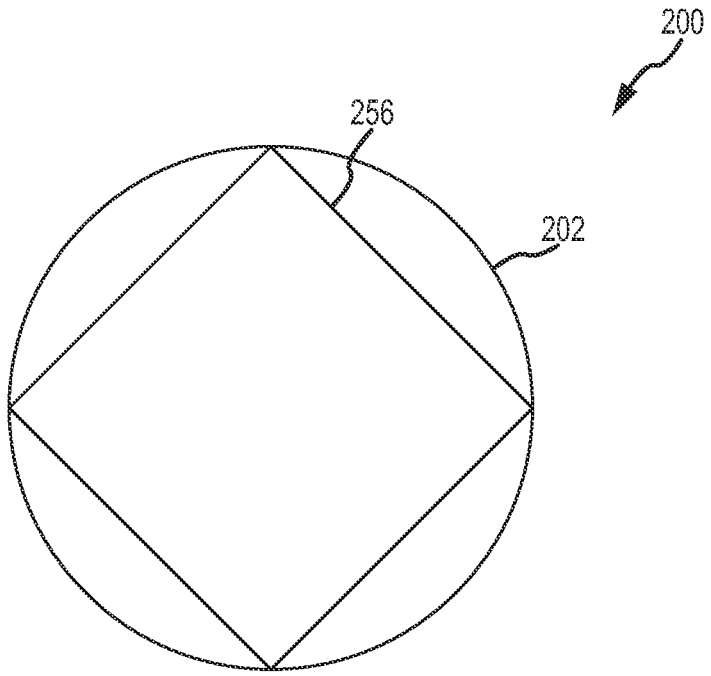

Other possible support structures include a combination of extruded triangles, such as those depicted in FIG. 4B, which depicts a support structure of four walls 254 that each pass through the axis A of the shaft 202. FIG. 4C depicts a support structure including a number of walls 256 that correspond to chords of the circular cross section of the shaft 202 of the arrow 200. Regardless of the configuration, the structure cross section may include external wall braces as well as internal structural supports. The widest part of the structural support may be equal in width to the inner diameter of the arrow shaft. The edges of the structure may be slightly rounded to avoid the generation of high stress contact loads where the structure meets the wall of the shaft 102, or other portions of the structure within the shaft 102. The reinforcing structure may be made from a thin-wall material, such as aluminum, and may be inserted into a hollow shaft after manufacturing.

Both the dimpled outer surface and internal structural support may be used in the same arrow. Such a shaft may be adapted for use with any type of arrow for any type of bow including quarrels for crossbows and long arrows for longbows as well as shorter arrows for compound bows.

The dimensions depicted in the various embodiments are for example only. Other embodiments having other dimensions are contemplated. Additionally, any dimension will inherently contain certain errors necessarily resulting from the standard deviation found in their respective testing measurements, manufacturing tolerances, etc.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified embodiments and examples. In this regard, any number of the features of the different embodiments described herein may be combined into one single embodiment and alternate embodiments having fewer than or more than all of the features herein described are possible.

While various embodiments have been described for purposes of this disclosure, various changes and modifications may be made which are well within the scope of the present technology. For example, the surface texture could, rather than being formed within the material of the shaft, could be created by a surface application of a coating such as a coating of paint or polymer treatment in which the surface texture is created, at least in part, by the placement and or texturing of the coating. In addition, other surface textures could be used including a scale-like texture of successive ridges. Numerous other changes may be made which will readily suggest themselves to those skilled in the art and which are encompassed in the spirit of the disclosure.

What is claimed is:

1. An arrow comprising:

a hollow elongate shaft comprising at least one interior wall, wherein the interior wall intersects the shaft at a rounded edge, and wherein the elongate shaft comprises an outer wall and the interior wall comprises a plurality of interior walls comprising chord walls;

a plurality of vanes located proximate a proximal end of the shaft; and a point located proximate a distal end of the shaft.

2. The arrow of claim 1, wherein the plurality of interior walls extend radially from a shaft axis.

3. The arrow of claim 1, wherein the plurality of interior walls comprise a first wall substantially concentric to the outer wall and a second wall connecting the first wall to the outer wall.

4. The arrow of claim 3, wherein the second wall comprises a plurality of second walls.

5. The arrow of claim 1, wherein the interior wall and the hollow shaft at least partially define a plurality of voids.

6. The arrow of claim 5, wherein the voids comprise at least one of a peripheral void and a central void.

7. An arrow comprising:

a hollow elongate shaft comprising an outer wall;

a support structure located within the shaft, wherein the support structure comprises:

an inner wall substantially concentric to the outer wall; and at least one wall brace located between the outer wall and the inner wall;

a plurality of vanes located proximate a proximal end of the shaft; and a point located proximate a distal end of the shaft.

8. The arrow of claim 7, wherein the shaft and the support structure comprise discrete elements.

9. The arrow of claim 7, wherein the support structure at least partially defines a plurality of voids.

10. The arrow of claim 9, wherein the voids comprise at least one of a peripheral void and a central void.

11. An arrow comprising:

a hollow elongate shaft comprising at least one interior wall, wherein the elongate shaft comprises an outer wall and the interior wall comprises a plurality of interior walls, and wherein the plurality of interior walls extend radially from a shaft axis, and wherein the plurality of interior walls comprise chord walls and intersect the shaft at rounded edges;

a plurality of vanes located proximate a proximal end of the shaft; and a point located proximate a distal end of the shaft.

12. The arrow of claim 11, wherein the plurality of interior walls comprise a first wall substantially concentric to the outer wall and a second wall connecting the first wall to the outer wall.

13. The arrow of claim 12, wherein the second wall comprises a plurality of second walls.

14. The arrow of claim 11, wherein the interior wall and the hollow shaft at least partially define a plurality of voids.

15. The arrow of claim 14, wherein the voids comprise at least one of a peripheral void and a central void.

* * * * *